US010639782B1

(12) United States Patent
Michuta

(10) Patent No.: US 10,639,782 B1
(45) Date of Patent: May 5, 2020

(54) SOCKET ORGANIZER AND STORAGE APPARATUS

(71) Applicant: Mathew Michuta, Phoenix, AZ (US)

(72) Inventor: Mathew Michuta, Phoenix, AZ (US)

( * ) Notice: Subject to any disclaimer, the term of this patent is extended or adjusted under 35 U.S.C. 154(b) by 27 days.

(21) Appl. No.: 15/987,815

(22) Filed: May 23, 2018

Related U.S. Application Data

(60) Provisional application No. 62/510,456, filed on May 24, 2017.

(51) Int. Cl.
*B25H 3/00* (2006.01)

(52) U.S. Cl.
CPC ..... *B25H 3/006* (2013.01)

(58) Field of Classification Search
CPC ..... B25H 3/006; B25H 3/003; B65D 37/00
USPC ..... 206/378, 6.1
See application file for complete search history.

(56) References Cited

U.S. PATENT DOCUMENTS 3,575,327 A * 4/1971 Harrison ..... A01K 97/08 294/149

* cited by examiner

*Primary Examiner* — Anthony D Stashick
*Assistant Examiner* — L Kmet
(74) *Attorney, Agent, or Firm* — Plager Schack LLP; Mark H. Plager; Eric Liou

(57) ABSTRACT

A socket storage apparatus for organizing a plurality of different-sized sockets by size is provided. The storage apparatus includes a rollable sheet, a plurality of rods having first ends coupled to a portion proximate the bottom edge of the sheet and second ends positioned proximate the top edge of the sheet, each rod designed to receive any number of the plurality of sockets for storage, each rod able to permit any one of the received plurality of sockets to slidably adjust along the rod for an attachment or detachment from the rod. The rollable sheet is able to roll to a storage position to secure the plurality of sockets present on any one of the plurality of rods. The rollable sheet is able to unroll to expose the plurality of sockets present on any one of the plurality of rods.

7 Claims, 4 Drawing Sheets

SOCKET ORGANIZER AND STORAGE APPARATUS

RELATED APPLICATION

The application claims priority to provisional patent application U.S. Ser. No. 62/510,456 filed on May 24, 2017, the entire contents of which is herein incorporated by reference.

BACKGROUND

The embodiments herein relate generally to storage devices for tools such as sockets. More specifically, embodiments of the invention are directed to a socket organizer and storage apparatus.

Individuals commonly use socket wrenches or ratchets as tools to perform maintenance and other tasks on automobiles, machinery or other equipment. These wrenches are configured for use with a plurality of attachable sockets, which can be deep sockets or shallow sockets in variable sizes. A socket with the desired size is attached to the wrench and the tool is used to turn a fastener such as a nut or bolt. Since a tool kit often comprises wrenches with a plurality of sockets, there is a need for a storage device that stores these items and prevents the misplacement or loss of any of the components.

There exist tool storage devices such as U.S. Patent Application Publication 2017/0157763, which comprises a tool holder with a plurality of slots configured to receive sockets, wrenches, and the like. However, this tool holder is limited because it does not conveniently organize sockets by size, which makes it inefficient for the user to identify and retrieve the desired socket for a particular task. U.S. Pat. No. 5,330,230 discloses a kit for identifying different-sized implements such as sockets or tools by adhering color-coded strips to the components, which correspond to a legend. However, this kit is limited because it does not organize implements such as sockets by size and provide a housing to store the items. As such, the user is required to rely on multiple kits and/or devices to both store and organize the socket tools and wrenches.

As such, there is a need in the industry for a socket organizer and storage apparatus that addresses the limitations of the prior art, which provides a compact rollable storage device that effectively stores and organizes sockets into their respective sizes. There is a further need for the storage apparatus to permit a user to identify and maneuver the sockets with enhanced efficiency.

SUMMARY

A socket storage apparatus for use in organizing a plurality of different-sized sockets by size is provided. The storage apparatus is configured to enhance efficiency in the storage and removal of the plurality of sockets. The storage apparatus comprises a rollable sheet comprising a top edge, a bottom edge opposite the top edge, and a pair of side edges connecting the top and bottom edges together, a plurality of rods comprising first ends coupled to a portion proximate the bottom edge of the sheet and second ends positioned proximate the top edge of the sheet, the plurality of rods extending along a top surface of the sheet and oriented generally perpendicular to a longitudinal axis of the sheet, each rod in the plurality of rods configured to receive any number of the plurality of sockets for storage, each rod in the plurality of rods configured to permit any one of the received plurality of sockets to slidably adjust along the rod for an attachment or detachment from the rod, wherein the rollable sheet is configured to roll to a storage position to secure the plurality of sockets present on any one of the plurality of rods, wherein the rollable sheet is configured to unroll to expose the plurality of sockets present on any one of the plurality of rods.

In an alternative embodiment, the socket storage apparatus comprises a base member, and a plurality of rods comprising first ends coupled to the base member and second ends, the plurality of rods extending upright and oriented generally parallel to each other, each rod in the plurality of rods configured to receive any number of the plurality of sockets for storage, each rod in the plurality of rods configured to permit any one of the received plurality of sockets to slidably adjust along the rod for an attachment or detachment from the rod.

BRIEF DESCRIPTION OF THE FIGURES

The detailed description of some embodiments of the invention will be made below with reference to the accompanying figures, wherein the figures disclose one or more embodiments of the present invention.

DETAILED DESCRIPTION OF CERTAIN EMBODIMENTS

Figure 1:
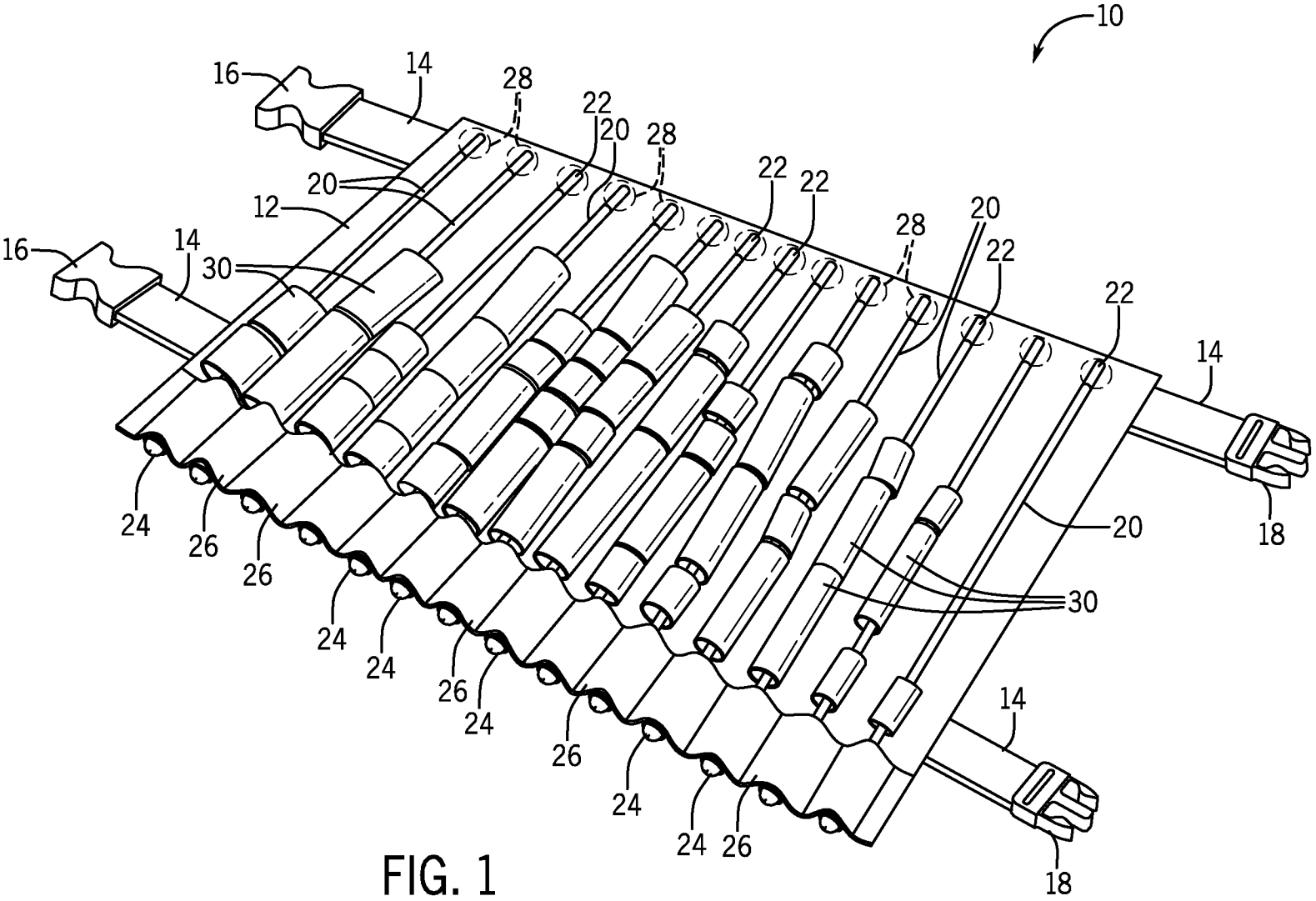
FIG. 1 depicts a perspective view of certain embodiments of the socket storage apparatus in an unrolled configuration.

As depicted in FIGS. 1-4, socket storage apparatus 10 is configured to organize sockets 30 into their respective sizes in one convenient storage device. This allows a user to easily identify a socket with a particular size and retrieve the item from the socket storage apparatus 10 for use to perform a task. Sockets 30 are commonly used with tools such as wrenches and ratchets. In certain embodiments, socket storage apparatus 10 generally comprises sheet 12, straps 14, threaded rods 20, and magnets 28.

Sheet 12 is preferably a rollable sheet made from a material such as nylon, rubber, or the like. In one embodiment, sheet 12 is made from double-ply 1000 Denier Cordura Nylon. However, alternative materials may be used. Sheet 12 preferably is a rectangular sheet. However, sheet 12 may have other shapes in alternative embodiments. Although socket storage apparatus 10 has been described as having a single sheet 12, it shall be appreciated that any number of sheets 12 may be coupled together to enhance the strength and durability of the apparatus. Sheets 12 may be coupled together by stitching, glue or alternative fastening components.

Figure 2:
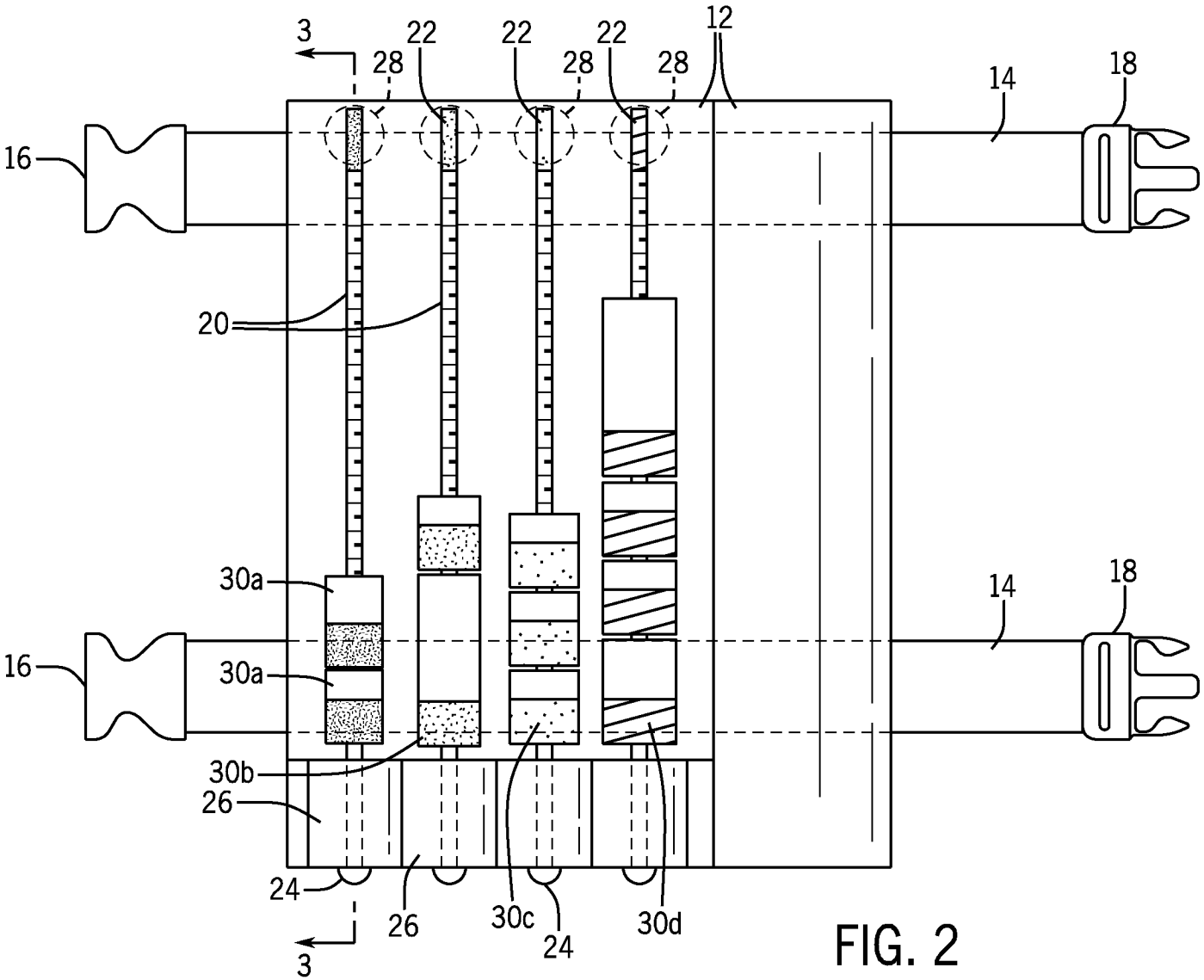
FIG. 2 depicts a top plan view of certain embodiments of the socket storage apparatus in a partially unrolled configuration.
Figure 3:
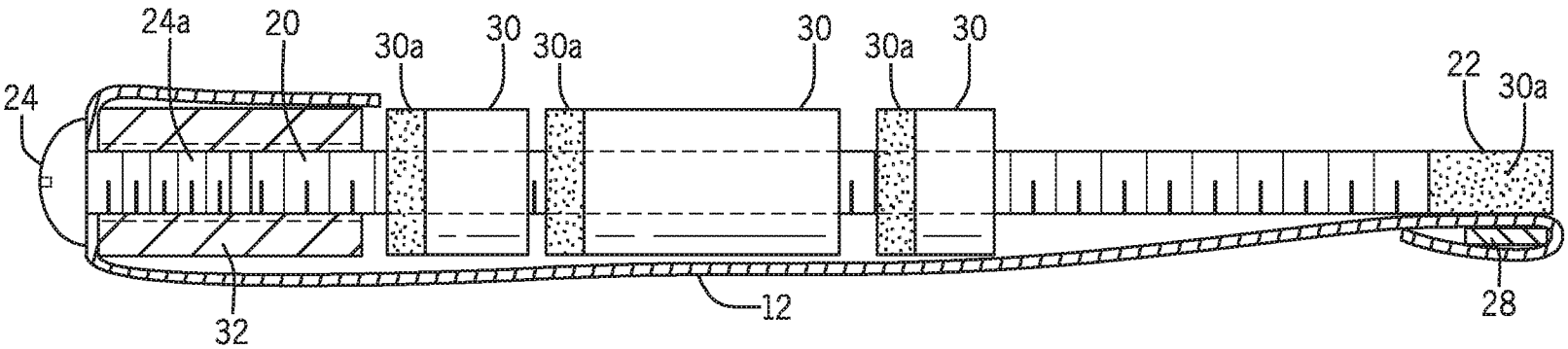
FIG. 3 depicts a section view of certain embodiments of the socket storage apparatus taken along line 3-3 in FIG. 2.

As depicted in FIGS. 1-3, the bottom edge of sheet 12 is folded over and coupled to the sheet to form a plurality of pockets 26 at the bottom of sheet 12. In one embodiment, pockets 26 are formed into distinct compartments using stitching or other means. The bottom portion of sheet 12 comprises a plurality of openings configured to receive round-head machine screws 24. Each round-head machine screw 24 comprises threads 24*a*, which are configured to engage with threaded coupler 32. It shall be appreciated that alternative types of threaded screws may be used instead of round-head machine screws 24.

A plurality of metallic threaded rods 20 is coupled to socket storage apparatus 10 and comprises first ends disposed within pockets 26 of sheet 12. In a preferred embodiment, each threaded rod 20 is approximately 12" in length and is configured to be inserted within any number of sockets 30 having diameters within the range of approximately 9 mm to 25 mm (0.35" to 0.98"). The first end of each threaded rod 20 is secured to the interior of one of pockets 26. More specifically, threaded coupler 32 is disposed within pocket 26, round-head machine screw 24 is inserted through one of the openings in sheet 12 to engage with approximately a first half of the interior threads of threaded coupler 32, and the first end of threaded rod 20 engages with approximately a second half of the interior threads of threaded coupler 32 inside pocket 26. All of threaded rods 20 are coupled to pockets 26 in the same manner.

Once assembled, threaded rods 20 extend along the top surface of sheet 12 and are oriented generally perpendicular to a longitudinal axis of the sheet. The top edge of sheet 12 is folded over and coupled to the sheet by stitching, an adhesive or alternative fastening means, to form an internal cavity. The internal cavity is configured to store magnets 28 so that they are embedded within sheet 12. In one embodiment, magnets 28 are neodymium magnets. However, alternative types of magnets may be used. Magnets 28 may be secured to sheet 12 within the internal cavity by an adhesive or alternative fastening components. As depicted in FIGS. 1-3, the second ends of threaded rods 20 are attracted to magnets 28 embedded within the internal cavity of sheet 12. As such, the second ends of threaded rods 20 are drawn towards magnets 28 and contact the portions of sheet 12 directly above magnets 28 in the resting position.

In one embodiment, visual markings such as color-coded tips 22 are coupled to the second ends of threaded rods 20. In one embodiment, each color-coded tip 22 on threaded rod 20 is different from the other color-coded tips 22 on the other threaded rods 20. Color-coded tips 22 may comprise different colors, patterns, symbols, alpha-numeric characters, and the like.

Sockets 30 are secured to socket storage apparatus 10 by detaching the second end of any threaded rod 20 from sheet 12. This allows sockets 30 to slide on, off, and along threaded rod 20 as desired. The second end of threaded rod 20 is reattached to sheet 12 above a corresponding magnet 28 to secure sockets 30 in place on the rod.

Sockets 30 are organized on threaded rods 20 by their respective sizes. In a preferred embodiment, sockets 30 are organized by their diameters. Sockets 30 with the same diameter are slidably mounted to the same threaded rod 20, regardless of whether sockets 30 are deep or shallow sockets. In one embodiment, each set of sockets 30 disposed on the same threaded rod 20 is identified by visual markings that correspond to color-coded tip 22 on threaded rod 20.

The visual markings comprise first color-coded visual markings 30*a* corresponding to a first set of sockets 30, second color-coded visual markings 30*b* corresponding to a second set of sockets 30, third color-coded visual markings 30*c* corresponding to a third set of sockets 30, fourth color-coded visual markings 30*d* corresponding to a fourth set of sockets 30, and so forth. Color-coded visual markings 30*a*, 30*b*, 30*c*, 30*d* are directly attached to the corresponding sets of sockets 30. Since each color-coded visual marking 30*a*, 30*b*, 30*c*, 30*d* matches color-coded tip 22 of one threaded rod 20, the user can easily identify, retrieve, return and maneuver any socket 30 relative to its corresponding threaded rod 20. In one embodiment, color-coded tips 22 and color-coded visual markings 30*a*, 30*b*, 30*c*, 30*d* are made from tape that is directly attached to threaded rods 20 and sockets 30.

In one embodiment, a pair of straps 14 is coupled to the bottom surface of sheet 12 by stitching, an adhesive or other fastening components. Each strap 14 extends generally parallel to the longitudinal axis of sheet 12 and comprises male fastener 18 on a first end and female fastener 16 on a second end. For each strap 14, male fastener 18 is configured to detachably couple to female fastener 16.

Figure 4:
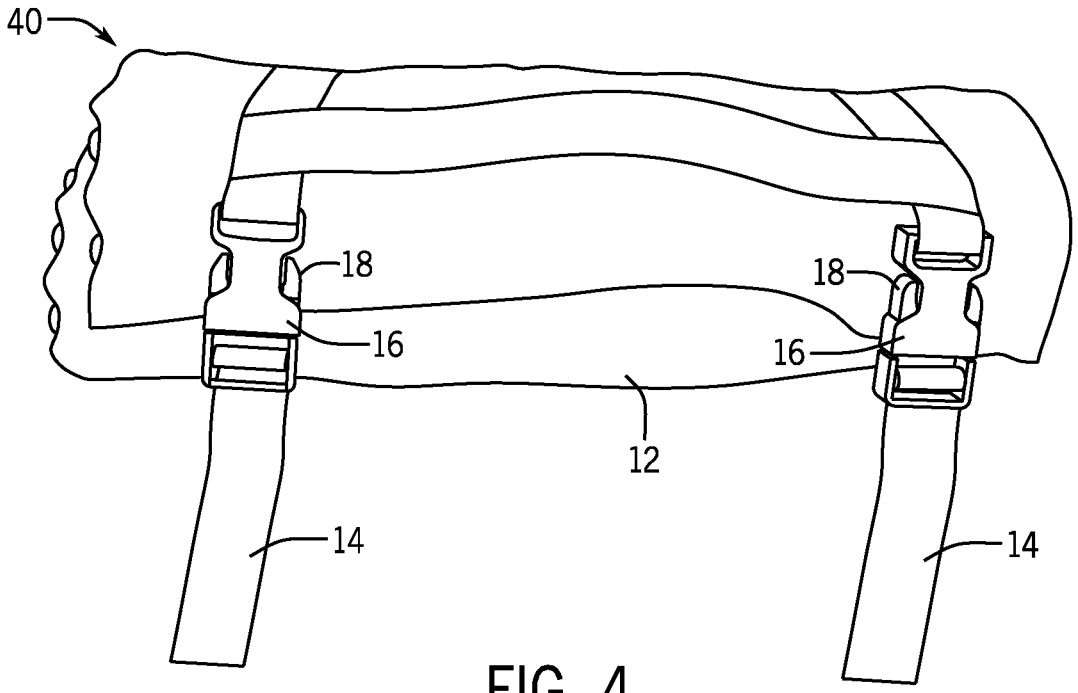
FIG. 4 depicts a perspective view of certain embodiments of the socket storage apparatus in a rolled-up storage configuration.

In operation, sockets 30 are slidably mounted to threaded rods 20 of socket storage apparatus 10. As depicted in FIG. 1, sockets 30 are exposed when socket storage apparatus 10 is in an unrolled configuration. In this configuration, the user can easily identify, remove and/or return any desired socket 30 from the corresponding threaded rod 20. The second ends of threaded rods 20 are attracted to magnets 28 to prevent the secured sockets 30 from sliding off threaded rods 20. Socket storage apparatus 10 can be rolled to a compact storage configuration to store sockets 30. FIG. 2 depicts sheet 12 in a partially rolled configuration. FIG. 4 depicts socket storage apparatus 10 in fully rolled-up configuration 40. In this configuration, straps 14 can be wound around sheet 12 to permit female fasteners 16 to engage with male fasteners 18. This secures socket storage apparatus 10 in the compact storage configuration.

Figure 5:
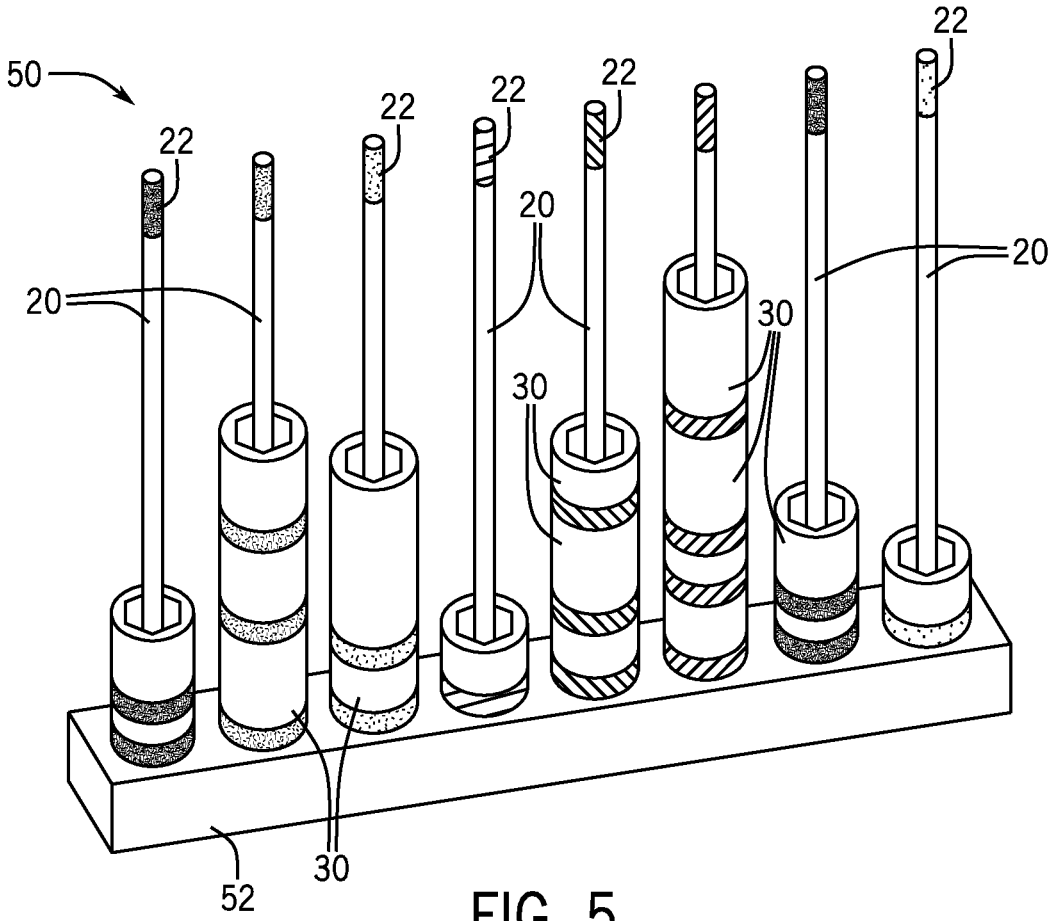
FIG. 5 depicts a perspective view of an alternative embodiment of the socket storage apparatus.

FIG. 5 depicts alternate socket storage apparatus 50, which is disposed on a flat surface such as a table, bench, floor, or the like. In certain embodiments, alternate socket storage apparatus 50 comprises base 52, threaded rods 20 and color-coded tips 22. Base 52 comprises any stable block with variable shapes including, but not limited to, a rectangular prism, cube, cylinder or other shape. The plurality of threaded rods 20 are coupled to the top surface of base 52 and oriented upright. In one embodiment, threaded rods 20 are oriented generally parallel to each other. Threaded rods 20, color-coded tips 22 and sockets 30 remain the same as previously described.

In operation, sockets 30 are slidably mounted to threaded rods 20 of alternate socket storage apparatus 50. In this configuration, the user can easily identify, remove and/or return any desired socket 30 from the corresponding threaded rod 20.

It shall be appreciated that the components of the socket storage apparatus described in several embodiments herein may comprise any alternative known materials in the field and be of any color, size and/or dimensions. It shall be appreciated that the components of the socket storage apparatus described herein may be manufactured and assembled using any known techniques in the field.

Persons of ordinary skill in the art may appreciate that numerous design configurations may be possible to enjoy the functional benefits of the inventive systems. Thus, given the wide variety of configurations and arrangements of embodiments of the present invention, the scope of the invention is reflected by the breadth of the claims below rather than narrowed by the embodiments described above.

What is claimed is:

1. A socket storage apparatus for use in organizing a plurality of different-sized sockets by size, the storage apparatus configured to enhance efficiency in the storage and removal of the plurality of sockets, the storage apparatus comprising:

a rollable sheet comprising a top edge, a bottom edge opposite the top edge, and a pair of side edges connecting the top and bottom edges together;

a plurality of rods comprising first ends coupled to a portion proximate the bottom edge of the sheet and second ends positioned proximate the top edge of the sheet, the plurality of rods extending along a top surface of the sheet and oriented generally perpendicular to a longitudinal axis of the sheet, each rod in the plurality of rods configured to receive any number of the plurality of sockets for storage, each rod in the plurality of rods configured to permit any one of the received plurality of sockets to slidably adjust along the rod for an attachment or detachment from the rod;

wherein the rollable sheet is configured to roll to a storage position to secure the plurality of sockets present on any one of the plurality of rods, wherein the rollable sheet is configured to unroll to expose the plurality of sockets present on any one of the plurality of rods, wherein the top edge of the sheet is folded over and coupled to the sheet to form an internal cavity within the sheet, and a plurality of magnets are embedded within the internal cavity, each magnet in the plurality of magnets configured to attract the second end of one of the plurality of rods.

2. The socket storage apparatus of claim 1, wherein the bottom edge of the sheet is folded over and coupled to the sheet to form a plurality of pockets configured to receive the plurality of rods, each pocket in the plurality of pockets configured to receive the first end of one of the plurality of rods.

3. The socket storage apparatus of claim 2, wherein each rod in the plurality of rods is a threaded rod.

4. The socket storage apparatus of claim 3, further comprising a plurality of threaded couplers disposed in the plurality of pockets in the sheet, each pocket in the plurality of pockets comprising one of the plurality of threaded couplers disposed therein, the first end of one of the plurality of rods being directly coupled to the one of the plurality of threaded couplers, and a mechanical fastener disposed through the sheet and being directly coupled to the one of the plurality of threaded couplers.

5. The socket storage apparatus of claim 4, further comprising a first strap coupled to a bottom surface of the sheet and extending generally parallel to the longitudinal axis of the sheet, the first strap comprising a first end with a first fastener and a second end with a second fastener, the first fastener configured to engage with the second fastener to secure the rollable sheet in the storage position.

6. The socket storage apparatus of claim 5, further comprising a second strap coupled to the bottom surface of the sheet and extending generally parallel to the longitudinal axis of the sheet, the second strap comprising a first end with a third fastener and a second end with a fourth fastener, the third fastener configured to engage with the fourth fastener to secure the rollable sheet in the storage position.

7. The socket storage apparatus of claim 6, further comprising a plurality of visual markings coupled to the second ends of the plurality of rods, each visual marking in the plurality of markings being different from the other visual markings in the plurality of visual markings.

* * * * *